United States Patent [19]

LaTulippe

[11] Patent Number: 4,850,598

[45] Date of Patent: Jul. 25, 1989

[54] DART GAME PRACTICE SHIELD

[76] Inventor: Michael A. LaTulippe, 24856 Ramona La., Moreno Valley, Calif. 92388

[21] Appl. No.: 189,796

[22] Filed: May 3, 1988

[51] Int. Cl.[4] ..... F41J 3/00

[52] U.S. Cl. ..... 273/408

[58] Field of Search ..... 273/408, 1 B; 434/404

[56] References Cited

U.S. PATENT DOCUMENTS

| | | | |
|---|---|---|---|
| 1,184,822 | 5/1916 | Camplette . | |
| 1,617,831 | 2/1927 | Wolke | 434/404 |
| 3,794,318 | 2/1974 | Holmes . | |
| 3,887,181 | 6/1975 | Samaras | 273/1 B |
| 3,895,800 | 7/1975 | King . | |
| 4,188,031 | 2/1980 | Fox . | |
| 4,389,193 | 6/1983 | Phillips | 434/404 X |

FOREIGN PATENT DOCUMENTS

| | | | |
|---|---|---|---|
| 161237 | 3/1921 | United Kingdom | 434/404 |
| 2149677 | 6/1985 | United Kingdom | 273/408 |

*Primary Examiner*—Paul E. Shapiro

*Attorney, Agent, or Firm*—Leon Gilden

[57] ABSTRACT

A dart game practice shield is set forth for use in combination with a regulation dart board. The shield is formed as a circular planar surface with a removable central cap overlying an opening of a first diameter less than that of the diameter of the practice shield. The opening diameter is equal to that of an underlying "bulls-eye" of an associated regulation dart board. The practice shield furthermore has an eighteen degree circular sector removed therefrom between said first diameter and an outer perimeter of the practice shield to enable an individual to practice proper dart placement on the unexposed portion of the dart board sector aligned with the open sector of the practice shield. The practice shield has a ring of hook and loop fasteners secured thereto on an interior face of said shield for securement to associated hook and loop fasteners attachment points about the associated regulation dart board. The shield is formed of a penetratable material, such as paperboard or plastic-like material for acceptance of darts utilized in the associated game.

5 Claims, 1 Drawing Sheet

DART GAME PRACTICE SHIELD

BACKGROUND OF THE INVENTION

1. Field of the Invention

The field of invention relates to dart boards, and more particularly pertains to a new and improved practice shield for use in combination with a regulation dart board which shield is utilized to expose one playing segment of the associated dart board.

2. Description of the Prior Art

The playing of a game of darts is a well known and well established game of chance and skill. The game is based upon an individual acquiring a selected number of points by striking the dart board with an associated dart and thereby collecting the aforenoted points. There individuals, however, that have difficulty in striking desired segments of an associated dart board target and in this occurrence, a shield is utilized in conjunction with the dart board for exposing only a desired segment thereof.

Examples of prior art games and shields is exemplified in U.S. Pat. No. 3,794,318 to Holmes where a hockey game utilizes a rotatable disc with openings spaced radially from a center of the disc to provide arcuate slots to expose underlying holes wherein the shield is rotated temporarily exposing such holes. The Holmes patent, however, does not provide a selectively securable shield in enhacing manual skill in the playing of the game of Darts, as does the instant invention.

U.S. Pat. No. 1,184,822 to Caplette, Jr. sets forth a shield formed as a plate with a central opening for reducing an underlying opening associated with a pocket underlying the shield. The patent, while of a structure and function relatively remote from that of the instant invention, does illustrate the use of an area reducing shield in association with a manually thrown object.

U.S. Pat. No. 3,887,181 to Samaras sets forth a game analogizing a hockey game wherein a plurality of fasteners are provided on a frame and are selectively disengageable to form random target areas on the framework for striking by a player.

U.S. Pat. No. 3,895,800 to King sets forth a ball catching game including a handle secured to a central portion of a flexible net which may be opened or closed wherein an electric motor is secured on a split rim securing the net with a gear of the motor meshing with teeth on opposed peripheries of the rim to open and close the rim when the motor is actuated by a switch in the handle. The patent is of interest only relative to a selectively closable shielding apparatus.

U.S. Pat. No. 4,188,031 to Fox sets forth a practice target for accepting a projectile including a plurality of laterally spaced upright posts securing a net closing the space therebetween with adjustable cross bar members positionable vertically relative to the spaced apart posts to define a variable height target area.

As such, it may be appreciated that there is a continuing need for a Dart game practice shield which addresses both the problem of ease of use and compatibility in enhancing manual skill in the playing of the game of Darts, and in this respect the present invention substantially fulfills this need.

SUMMARY OF THE INVENTION

In view of the foregoing disadvantages inherent in the known types of practice shields now present in the prior art, the present invention provides an Dart game practice shield wherein the same is readily and efficiently associated with an attendant dart board for exposing only selected portions of a dart board requiring a user of the device to therefore concentrate practice on such exposed area. As such, the general purpose of the present invention, which will be described subsequently in greater detail, is to provide a new and improved Dart game practice shield which has all the advantages of the prior art practice shields and none of the disadvantages.

To attain this, the present invention comprises an annular plate that may be formed with an orthogonally secured peripheral skirt for overlying the face of an associated regulation dart board wherein the dart board is formed of twenty pie-shaped segments reading from a central "bulls-eye". The practice shield has a selectively removable "bulls-eye" opening and a single exposed opening formed as a truncated pie-shaped segment directed outwardly from the "bulls-eye" opening of the shield. The shield has fastening elements such as "hook and loop fasteners" or spikes to temporarily secure the shield to the associated dart board.

My invention resides not in any one of these features per se, but rather in the particular combination of all of them herein disclosed and claimed and it is distinguished from the prior art in this particular combination of all of its structures for the functions specified.

There has thus been outline, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Pat. and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved Dart game practice shield which has all the advantages of the prior art practice shields and none of the disadvantages.

It is another object of the present invention to provide a new and improved Dart game practice shield which may be easily and efficiently manufactured and marketed.

It is a further object of the present invention to provide a new and improved Dart game practice shield which is of a durable and reliable construction.

An even further object of the present invention is to provide a new and improved Dart game practice shield which is susceptible of a low cost of manufacture with regard to both materials and labor, and which accordingly is then susceptible of low prices of sale to the consuming public, thereby making such Dart game practice shield economically available to the buying public.

Still yet another object of the present invention is to provide a new and improved Dart game practice shield which provides in the apparatuses and methods of the prior art some of the advantages thereof, while simultaneously overcoming some of the disadvantages normally associated therewith.

Still another object of the present invention is to provide a new and improved Dart game practice shield wherein an annular plate is formed for an overlying relationship to a regulation dart board for exposing only a single of the twenty pie-shaped segments of the dart board for practice striking of that segment. Furthermore the shield has a selectively removable central cap for enabling practice striking of a "bulls-eye" associated with a Dart board.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
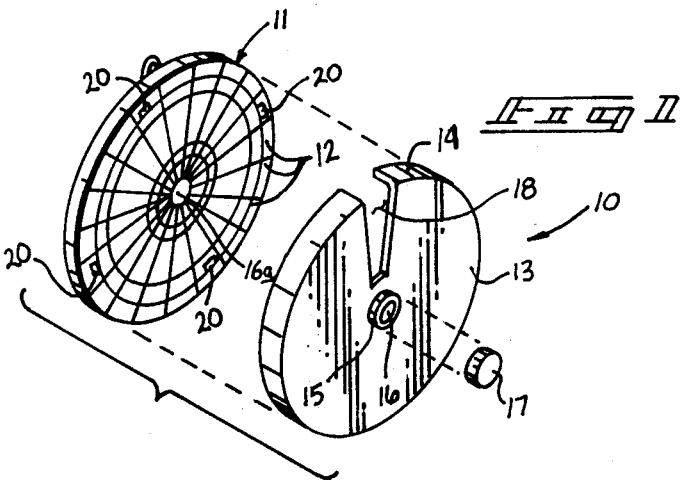
FIG. 1 is an isometric illustration of the instant invention.

With reference now to the drawings, and in particular to FIGS. 1 to 7 thereof, a new and improved Dart game practice shield embodying the principles and concepts of the present invention and generally designated by the reference numeral 10 will be described.

More specifically, it will be noted that the Dart game practice shield apparatus 10 is utilized in combination with an associated regulation dart board 11 formed with a playing surface divided into twenty pie-shaped target segments 12 of varying valuations. The practice shield 10 is formed as a substantially annular disc with an outer face 13 and an optional orthogonal skirt 14 circumferentially secured to the outer peripheral edge of the shield 10. The outer diameter of the shield 10 interiorly of the skirt 14 is of a diameter to accept in a complementary fashion the dart board 11 therewithin with the skirt of a depth substantially equal to the depth of the dart board 11.

Secured axially of the shield 10 directed outwardly of the face 13 is a cap projection 15 orthogonally directed outwardly of the face 13 of a diameter defining a "bulls-eye" opening 16 which said opening is equal to that of the "bulls-eye" **16*a* of the dart board 11. A bulls eye cover cap 17 is positionable in an overlying relationship to the projection 15 when the "bulls-eye" target 16*a*** is not desired in use of the shield by an individual.

A single truncated triangular opening 18 is formed radially of the central axis of the shield 10 of a dimension to correspond to one of the equally spaced pie-shaped segments 12 of the dart board 11. In this manner, and individual may thereby practice on a particular segment of the dart board 11 that the individual may have particular problems with in striking with a dart "D" associated with the game. It is also understood that as twenty equally spaced segments 12 are utilized, each segment defines an arc of eighteen degrees wherein the opening 18 is therefore also of an eighteen degree circular segment.

Figure 2:
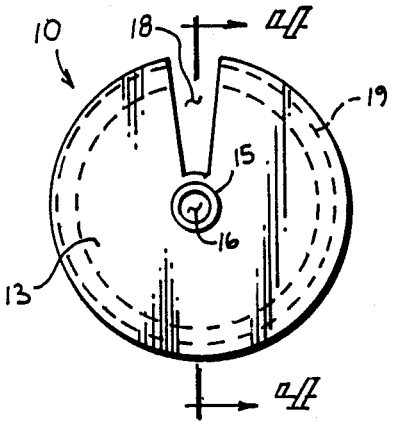
FIG. 2 is an orthographic view taken in elevation of the instant invention.
Figure 3:
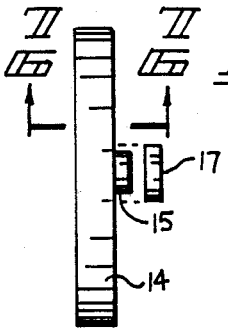
FIG. 3 is an orthographic side view taken in elevation of the instant invention.
Figure 4:
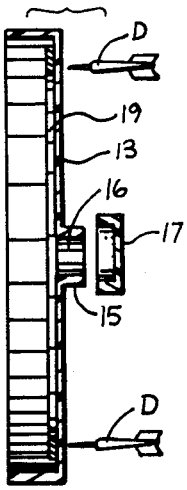
FIG. 4 is an orthographic view taken along the lines 4—4 of FIG. 2 in the direction indicated by the arrows.

To secure the shield 10 to the associated dart board 11, a first hook and loop fastener portion is secured to an interior surface of the shield 10 as indicated in FIGS. 2 and 4 to cooperate with complementary hook and loop fastener portion fastening elements 20 securable at a plurality of orientations about the face of the dart board 11. In this manner, the shield 10 may be angularly oriented with respect to the dart board 11 as desired to expose one of a selective segment 12.

Figure 5:
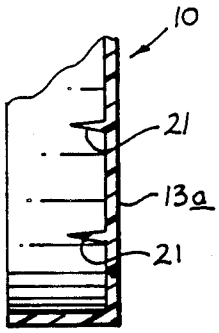
FIG. 5 is a partial section of the shield of the instant invention illustrating an alternate means of association of the shield to the dart board.

Alternatively to the use of hook and loop fasteners, spikes 21 may be formed to the interior surface of shield 10, as illustrated in FIG. 5, to impale into the face of the dart board 11 to accordingly secure the shield thereto.

Figure 6:
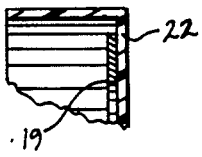
FIG. 6 is an orthographic view taken along the lines 6—6 of FIG. 3 in the direction indicated by the arrows illustrating a plastic-like material utilized in the instant invention.
Figure 7:
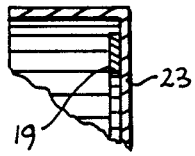
FIG. 7 is an orthographic illustration taken along the lines 7—7 of FIG. 3 in the direction indicated by the arrows illustrating a fiber board material utilized in the instant invention.

The shield itself is made of a relatively soft plastic 22, as indicated in FIG. 6, whereupon a dart "D" will penetrate the plastic thereby not harming the sharpened point of the dart and furthermore, enabling the dart to stick into the surface 13 of the shield 10 to visually indicate to a user the proximity of the dart to the selected opening 18. Alternatively, the shield could be formed of a fiber board material 23, as indicated in FIG. 7.

As to the manner of usage and operation of the present invention, the same should be apparent from the above description. Accordingly no further discussion relative to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A dart game practice shield in combination with an annular dart board formed with an annular circumference of a first diameter;

said dart board including a dart board surface with a central annular target of a second diameter substantially less than said first diameter, and an area between said annular target and said annular circumference equally divided into annular pie-shaped dart board segments, said shield including an annular disc means for securement over said dart board surfaces;

said disc means including a shield segment opening equal to one of said dart board segments and aligned with one of said dart board segments when secured over said dart board surface, and said disc means further including a selectively closable central opening of a diameter substantially equal to and aligned with said second diameter when said shield is secured over said dart board surface, and wherein said shield further includes an orthogonal skirt integrally formed to a terminal exterior edge of said shield to define a shield diameter interiorly of said skirt substantially equal to said first diameter, and wherein said central opening is defined by an orthogonally secured annular projection directed outwardly of said disc means and further including a cap securable to said projection.

2. A Dart game practice shield as set forth in claim 1 wherein said shield further includes securement means comprising a single hook and loop fastener strip secured to an interior surface of said shield and cooperating with a plurality of complementary hook and loop fastener segments secured to said dart board surface.

3. A Dart game practice shield as set forth in claim 1 wherein said shield further includes securement means wherein said securement means include a plurality of spikes integrally formed to an interior surface of said shield for penetration of said dart board surface and securement of said shield thereto.

4. A Dart game practice shield as set forth in claim 1 wherein said shield is formed of a fiber board material.

5. A Dart game practice shield as set forth in claim 1 wherein said skirt is of a depth substantially equal to a thickness defined by said dart board to accept said dart board in a recess defined by said skirt and an interior surface of said shield in a recess of complementary configuration to said dart board.

* * * * *